US007464768B2

(12) United States Patent
Wang

(10) Patent No.: US 7,464,768 B2
(45) Date of Patent: Dec. 16, 2008

(54) INTAKE AND EXHAUST GUIDE DEVICE FOR PNEUMATIC TOOL

(75) Inventor: Wen-Yuan Wang, Keelung (TW)

(73) Assignee: Double Dynasty Co., Ltd., Keelung (TW)

( * ) Notice: Subject to any disclaimer, the term of this patent is extended or adjusted under 35 U.S.C. 154(b) by 0 days.

(21) Appl. No.: 11/652,657

(22) Filed: Jan. 12, 2007

(65) Prior Publication Data

US 2008/0023209 A1 Jan. 31, 2008

(30) Foreign Application Priority Data

Jul. 31, 2006 (TW) ..... 95213386 U

(51) Int. Cl.
*B25D 11/00* (2006.01)

(52) U.S. Cl. ..... 173/168; 173/169; 173/170; 173/213; 173/218

(58) Field of Classification Search ..... 173/168, 173/169, 93.5, 170, 213, 218; 181/228, 230
See application file for complete search history.

(56) References Cited

U.S. PATENT DOCUMENTS 3,033,236 A * 5/1962 Rayman et al. ..... 137/624.15
3,719,251 A * 3/1973 Hedrick ..... 181/230
3,964,212 A * 6/1976 Karden ..... 451/358
4,102,084 A * 7/1978 Bloomquist ..... 451/357
4,258,798 A * 3/1981 Campbell et al. ..... 173/168
4,671,019 A * 6/1987 Hutchins ..... 451/357
5,901,794 A * 5/1999 Schoeps et al. ..... 173/93.5
5,954,142 A * 9/1999 Rahm ..... 173/169
6,131,390 A * 10/2000 Hsieh ..... 60/407
6,196,331 B1 * 3/2001 Naito et al. ..... 173/169
6,834,499 B2 * 12/2004 Lin ..... 60/407
2004/0159451 A1 * 8/2004 Taga ..... 173/169
2006/0108136 A1 * 5/2006 Leu ..... 173/201

* cited by examiner

*Primary Examiner*—Rinaldi I. Rada
*Assistant Examiner*—Michelle Lopez
(74) *Attorney, Agent, or Firm*—Troxell Law Office, PLLC

(57) ABSTRACT

An intake and exhaust guide device for pneumatic tool including a handle, a pressure shunt connector, and two pressure tubes. The handle has a cylindrical hole. The pressure shunt connector is inserted into an outer end of the handle. The pressure shunt connector has a cylindrical hole and a screw hole forming an exhaust passage of the pneumatic tool. The cylindrical hole of the pressure shunt connector has an extension rod and an elongated hole with a ring-shaped groove. The extension rod is inserted through the elongated hole and connected to an intake screw hole of the handle. Each of the two pressure tubes is connected to one of the elongated hole and the screw hole of the pressure shunt connector.

3 Claims, 4 Drawing Sheets

INTAKE AND EXHAUST GUIDE DEVICE FOR PNEUMATIC TOOL

BACKGROUND OF THE INVENTION

1. Field of the Invention

This invention relates to a pneumatic tool, and particularly to an intake and exhaust guide device for pneumatic tool.

2. Description of the Prior Art

In a conventional pneumatic tool, the tool assembly thereof is actuated with a motor which is operated with a compressed air upon being exhausted simulataneously.

In a conventional pneumatic tool, a compressed air enables a tool assembly to work through a pneumatic motor; at the same time, a perfect exhaust passage must be furnished for exhausting the compressed air so as to convert such compressed air into a power, i.e., a perfect energy exchange can be fulfilled; relatively, the noise would be at the highest point during working.

How to muffle the noise of a pneumatic tool during the compressed air exhausting and during the energy exchange being done has become a serious and interesting question.

SUMMARY OF THE INVENTION

The prime object of the present invention is to provide an intake and exhaust guide device for pneumatic tool, in which the outer end of the handle is connected with a pressure shunt connector; the two screw holes of the connector are connected respectively with two connectors of two pressure tubes fastened together in parallel. When the pneumatic tool is operating, the cock is used for controlling the compressed air to take in and exhaust simultaneously through a muffler so as to muffle the noise effectively.

Another object of the present invention is to provide an intake and exhaust guide device for pneumatic tool, in which the two parallel pressure tubes are mounted with two connectors respectively at the ends thereof; the outer end of the handle is mounted with a pressure shunt connector so as to facilitate the intake and exhaust of a compressed air during a pneumatic tool working in order to simplify the structure of a pneumatic tool.

Another object of the present invention is to provide an intake and exhaust guide device having two parallel pressure tubes for pneumatic tool, in which the intake and exhaust ends each is furnished with a separate passage to the outer connector so as to simplify the structure of the intake and exhaust ends.

Still another object of the present invention is to provide an intake and exhaust guide device for pneumatic tool, in which one pressure tube is directly connected with an output end of a compressed air tank of a compressor, or with a three-way connector for supplying compressed air.

A further object of the present invention is to provide an intake and exhaust guide device having two parallel pressure tubes for pneumatic tool, in which one of the two pressure tubes has a suitable diameter; one end of the pressure tube is connected with the pneumatic tool via an exhaust connector; the pressure tube in the parallel section is connected with a muffler connector so as to separate the noise of the pneumatic tool from the work site.

Still a further object of the present invention is to provide an intake and exhaust guide device having two parallel tubes for pneumatic tool, in which the working site of the pneumatic tool is separated from a muffler via an exhaust tube so as to isolate the noise from the working site completely.

Yet, another object of the present invention is to provide an intake and exhaust guide device having two parallel tubes for pneumatic tool, in which the exhaust noise of the compressed air would not be heard any more during the pneumatic tool working on site.

FIG. Is a plan view of the present invention, showing the assembled structure of the intake and exhaust guide device for pneumatic tool.

Figure 3:
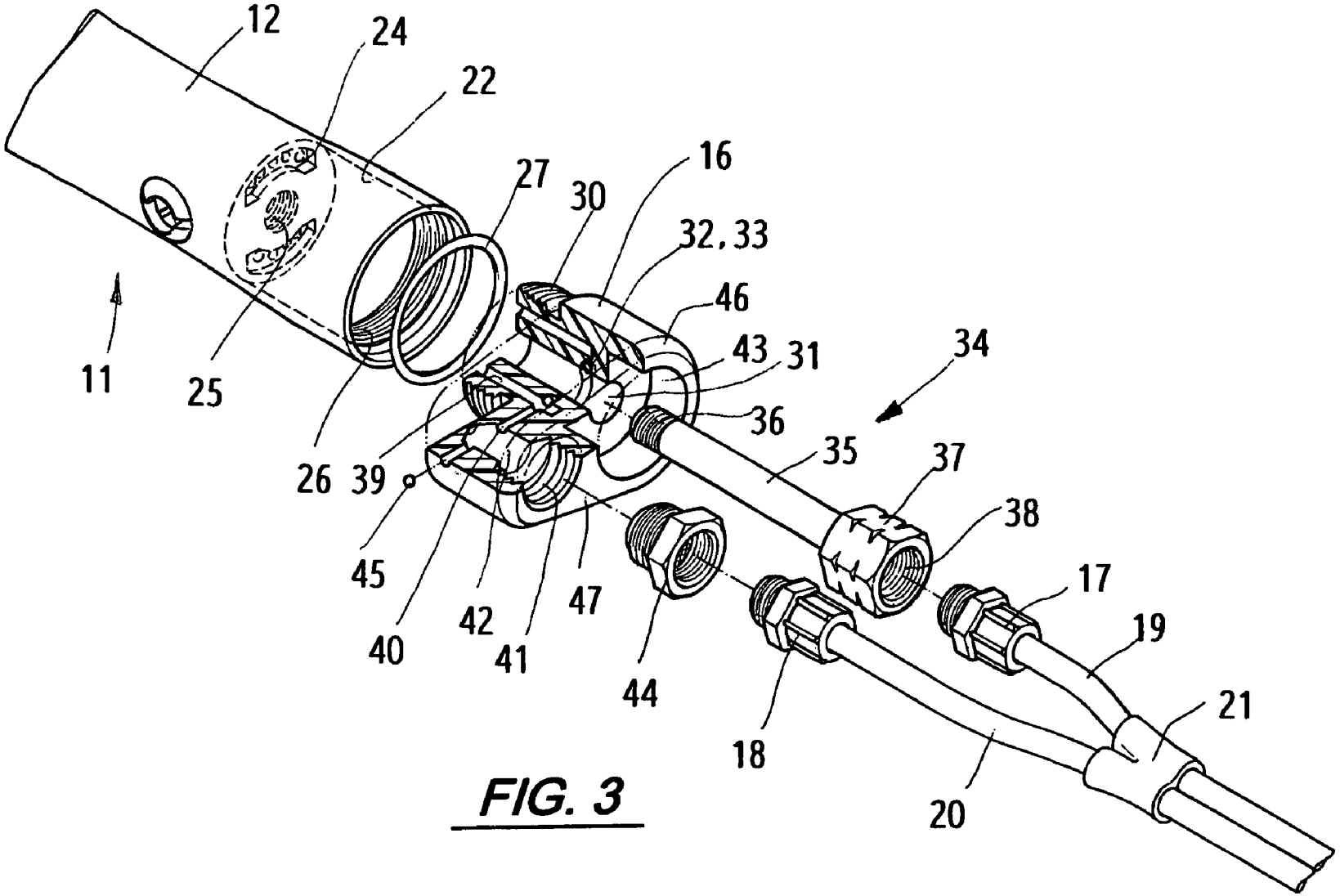

FIG. 3 is a disassembled view of the present invention, showing the relation among the parts of the intake and exhaust guide device for pneumatic tool.

Figure 4:
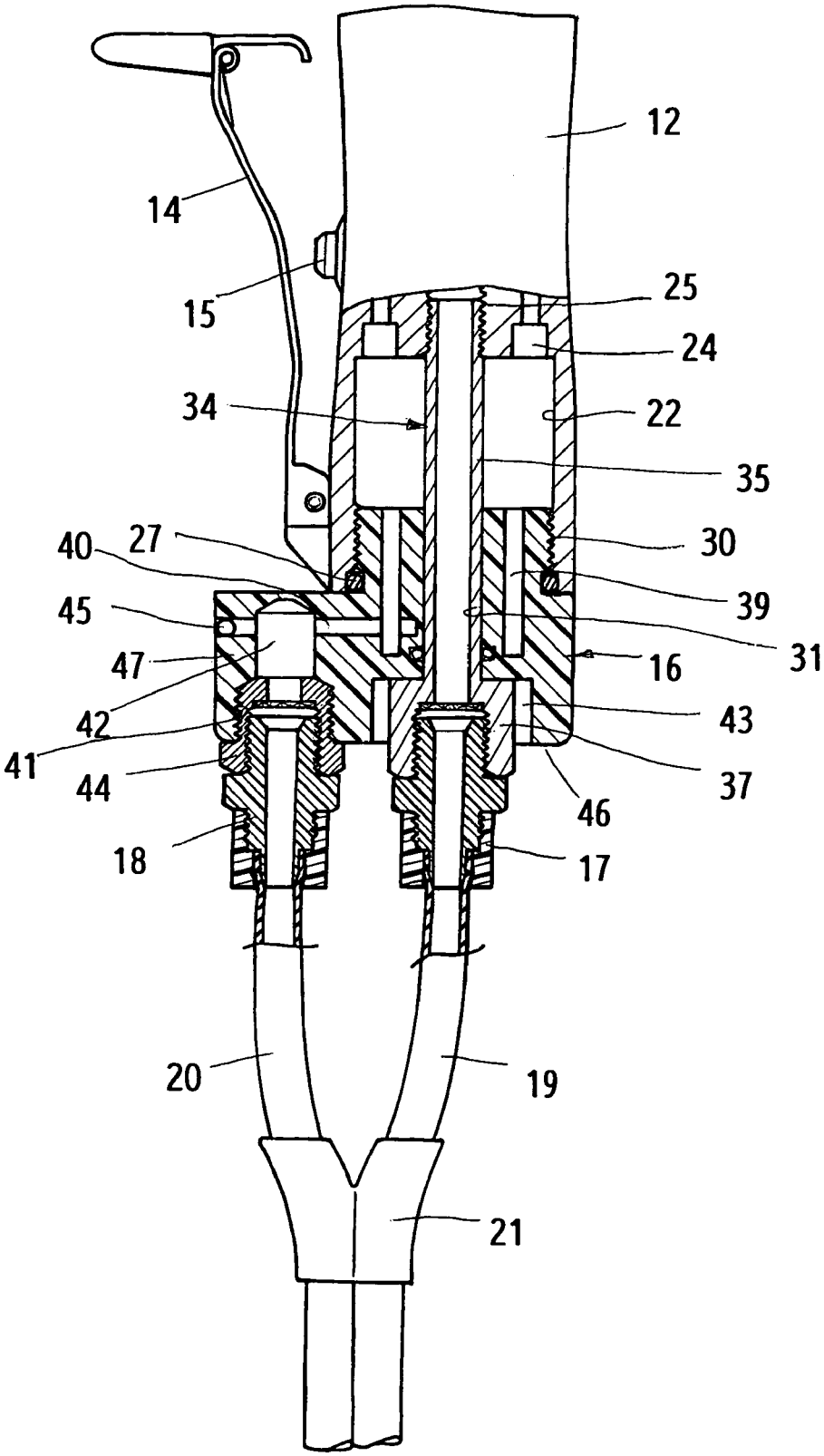

FIG. 4 is a sectional view of the present invention, showing the intake and exhaust structure of the pneumatic tool thereof.

DETAILED DESCRIPTION OF THE PREFERRED EMBODIMENT

Figure 1:
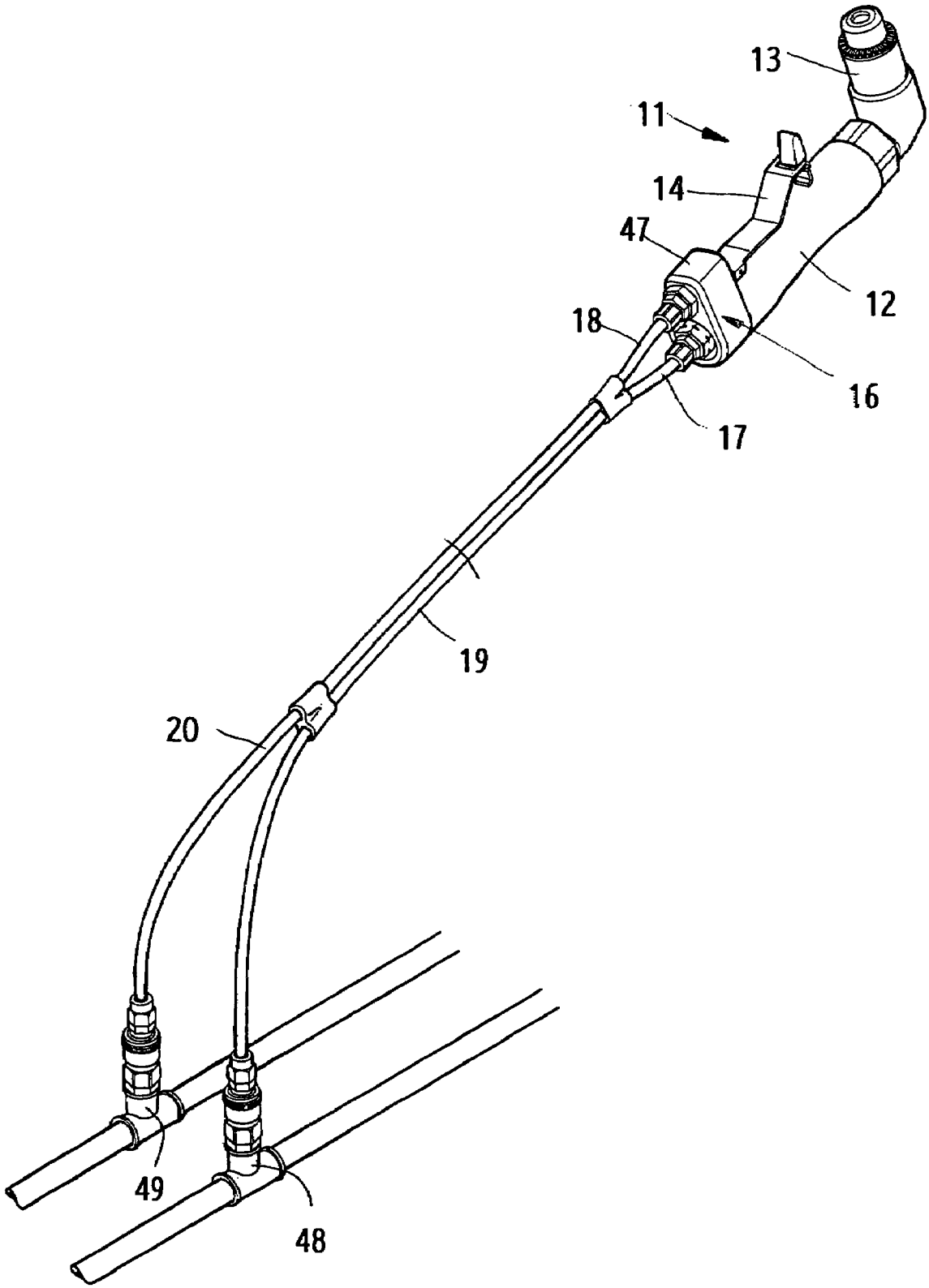
FIG. 1 is a perspective view of the intake and exhaust guide device for pneumatic according tool according to the present invention.
Figure 2:
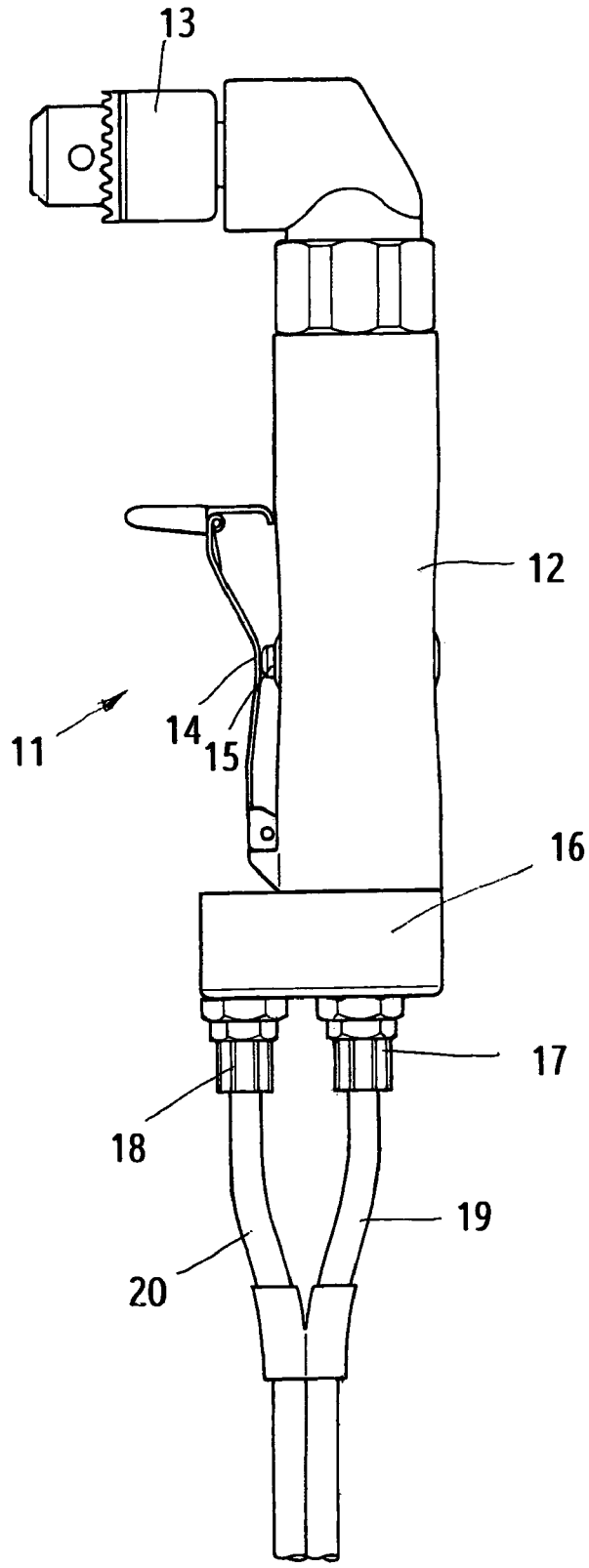

This invention relates to an intake and exhaust guide device for pneumatic tool; as shown in FIGS. 1 and 2, the pneumatic tool 11 comprises a handle 12, which has a cock 14 is used for controlling the flow of compressed air; as soon as the compressed air enters a pneumatic motor in the handle 12, the pneumatic motor will actuate the tool assembly 13. The cock 14 controls the valve assembly 15; after the compressed air flows in, it will flow through an exhaust passage, and a pressure shunt connector 16 to guide the compressed air to be exhausted via a connector 18.

Referring to FIGS. 1 to 4, the outer end of the handle 12 for mounting a valve assembly 15 in the pneumatic tool 11 is furnished with a cylindrical hole 22 which has a screw hole 25; then, a pressure shunt connector 16 is to be mounted in the cylindrical hole 22 so as to facilitate the outer threads 36 of an extension rod 34 to connect in place. The outer end of the extension rod 34 is furnished with a screw hole 38 to facilitate the compressed air in the pressure tube 19 to flow into the screw hole 25 via the connector 17 and the intake passage of the handle 12.

The extension rod 34 mounted in the screw hole 25 of the cylindrical hole 22 in the handle 12 is furnished with outer threads 36 at one end of the stem part 35 thereof, while the other end thereof is furnished with a hexagonal connector 37; the stem part 35 extends through an elongate hole 31 in a pressure shunt connector 16; the outer threads 36 of the stem part 35 engage in the screw hole 25 of the cylindrical hole 22 in the handle 12. After the pressure shunt connector 16 is mounted at the outer end of the cylindrical hole 22, the intake and exhaust tubes of the pneumatic tool 11 are separated.

The pressure shunt connector 16 at the outer end of the handle 12 is furnished with a screw rod 30 to be engaged in the screw hole 26; one end of the screw rod 30 is mounted with an O-ring 27, which is used as a seal ring upon the pressure shunt connector 16 being mounted in the screw hole 25 of the handle 12.

The screw rod 30 of the pressure shunt rod 16 is screwed in one end of the handle 12; the center of the screw rod 30 is furnished with a through elongate hole 31; the inside of the elongate hole 31 is furnished with a ring-shaped groove 32 for receiving an O-ring 33. The outer side of the elongate hole 31 of the screw rod 30 is furnished with a ring-shaped groove 39 having a suitable depth.

The pressure shunt connector 16 has a main base 46 is mounted at one end of the handle 12; a side base 47 is furnished beside the main base 46, and the two bases 46 and 47 are cast together in a tangent circle shape, which is the outer shape of the pressure shunt connector 16. The center of the side base 47 of the pressure shunt connector 16 has a screw hole 41 to be connected with a replaceable connector 44, or with a connector 18 of a pressure tube 20. The bottom center of the screw hole 41 in the side base 47 is furnished with a bottom hole 42; between the bottom hole 42 and the ring-shaped groove 39 of the screw rod 30, there is a straight hole 40 through the side base 47, the bottom hole 42, and the ring-shaped groove 39; the straight hole 40 is sealed with a small ball 45.

The screw hole 41 in the center of the side base 47 is connected with a replaceable connector 44, or a connector 18 of the pressure tube 20. The bottom hole 42 of the screw hole 41 is in communication with the ring-shaped groove 39 of the main base 46 via the horizontal straight hole 40; further, the ring-shaped groove 39 is in communication with the cylindrical hole 22 of the handle 12 connected together with the screw rod 30 so as to form into a through passage.

To assemble the intake and exhaust guide device in the pneumatic tool 11, the pressure shunt connector 16 should first be connected with the outer end of the handle 12; i.e., the screw rod 30 of the pressure shunt connector 16 is screwed in the screw hole 26; the elongate hole 31 of the screw rod 30 and the cylindrical hole 22 of the handle 12 will be in communication with each other. The main base 46 of the pressure shunt base 16 has a cylindrical hole 43, which is furnished with a through elongate hole 31; the elongate hole 31 is furnished with a suitable ring-shaped groove 32 and an O-ring 33; an extension rod 34 is plugged into the elongate hole 31 of the connector 17; and the outer threads 36 of one end thereof is engaged in a screw hole 25 of the cylindrical hole 22 in the handle 12. The extension rod 34 has a suitable length and has a hexagonal connector 37 at the outer end thereof; the hexagonal connector 37 has a center screw hole 38; the outer threads 36 at the inner end of the extension rod 34 is connected with the screw hole 25 of the cylindrical hole 22; in that case, the extension rod 34 would provide the pressure shunt connector 16 and the handle 12 with a second fastening means; then, the intake passage and the exhaust passage in the handle 12 will be partitioned.

The center of the main base 46 in the pressure shunt connector 16 has a screw hole 38, which is the center of the hexagonal connector 37 on the extension rod 34; the inside thereof is in communication with the intake passage of the handle 12. The screw hole 38 of the pressure shunt connector 16 is connected directly with a connector 17 of a pressure tube 19, which has a suitable length.

According to the difference of environment, the compressor of the pneumatic tool 11 may be connected with a pressure tube 19 with a snap connector, or connected with a pressure tube and a three-way connector 48; the handle 12 of the pneumatic tool 11 is connected with two pressure tubes 19 and 20 through connectors respectively; one pressure tube 19 has a suitable length, and the tail end thereof is connected with a snap connector, which is then connected with a three-way connector 48.

The screw hole 41 of the pressure shunt connector 16 of the handle 12 is directly connected with a connector 18 of another pressure tube 20, or the pressure tube 20 may be connected with the screw hole 41 of the pressure shunt connector 16 through a replaceable connector 44. The inner passage includes the ring-shaped groove 39 of the pressure shunt connector 16, a cylindrical hole 22, and an exhaust hole 24 of the valve assembly 15 to form into an exhaust passage upon the pneumatic tool 11 being operated.

The exhaust passage is not in communication directly with the outside; instead, the compressed air is exhaust and guided out through a connector 18 of the pressure shunt connector 16 and the pressure tube 20. The pressure tube 20 and the pressure tube 19 are fastened together in parallel, and both of then have a suitable length. The tail end of the exhaust pressure tube 20 is connected with a thread-type connector or a snap connector, which is then connected with a muffler; a snap connector may also be connected with a three-way connector 49 via a snap connector so as to have the exhausted air guided into a muffler.

The outer end of the handle 12 is connected with a pressure shunt connector 16, which is then connected with two pressure tubes 19 and 20 so as to have a compressed air guided to the front end of a valve assembly 15 of the pneumatic tool 11. During the pneumatic tool being operated the cock 14 is used for controlling the valve assembly 15 to guide a suitable volume of compressed air work, and simultaneously the compressed air guided in for working must be exhausted timely via the connector 18 of the pressure shunt connector 16 on the handle 12, the pressure tube 20, and the muffler; in that case, when the compressed air drives the tool assembly 13 to work, only the noise of the tool assembly 13 is left on the working site because of the exhaust noise being guided out completely, e., the noise of the pneumatic tool has been improved effectively.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. An intake and exhaust guide device for pneumatic tool comprising:

a pneumatic tool including a handle with a cock and a body; one end of said body furnished with a tool assembly; an inner side of said cock furnished with a valve assembly, and an outer end of said valve assembly furnished with a cylindrical hole extended out of said handle; said cylindrical hole connected with a pressure shunt connector;

a pressure shunt connector, of which one end furnished with a screw rod, while other end thereof furnished with a main base having a through elongate hole in center thereof; the center of said screw rod having a ring-shaped groove with a suitable depth; one side of said main base having a side base with a screw hole and a bottom hole on bottom thereof; said bottom hole in said side base and a ring-shaped groove in said screw rod being in communication through a straight hole of the side base;

an extension rod having a hollow stempart with a suitable length, and one end thereof furnished with outer threads, while other end thereof furnished with a hexagonal connector having a screw hole; said extension rod mounted in and through the through elongate hole of said pressure shunt connector, while one end thereof mounted in a screw hole in one end of said handle;

a first pressure tube connected with a connector to the main base of the shunt connector at one end and connected with a first three-way connector to an intake pressure source at the other end;

a second pressure tube connected with a connector to the side base of the shunt connector at one end and connected to a muffler at the other end;

both pressure tubes being fastened together in parallel at a point between their respective ends, while the ends are separated from each other.

2. The intake and exhaust guide device for pneumatic tool as claimed in claim 1, wherein a pressure shunt connector mounted in said handle, and the center of said screw rod of said pressure shunt connector furnished with an elongate hole, in which a hollow extension rod is mounted through and then extending and screwed in an intake screw hole of said valve assembly; a hollow stem part in said extension rid dividing a passage in outer end of said valve assembly into an intake passage and an exhaust passage.

3. The intake and exhaust guide device for pneumatic tool as claimed in claim 1, wherein the second pressure tube is connected to an exhaust system via a three-way connector.

* * * * *